US012359407B2

(12) United States Patent
Camozzi

(10) Patent No.: US 12,359,407 B2
(45) Date of Patent: Jul. 15, 2025

(54) APPARATUS AND METHOD FOR INSTALLING DECK MOUNTED FAUCETS

(71) Applicant: Michael Camozzi, Spring Valley, CA (US)

(72) Inventor: Michael Camozzi, Spring Valley, CA (US)

( * ) Notice: Subject to any disclaimer, the term of this patent is extended or adjusted under 35 U.S.C. 154(b) by 182 days.

(21) Appl. No.: 18/222,988

(22) Filed: Jul. 17, 2023

(65) Prior Publication Data

US 2024/0060280 A1 Feb. 22, 2024

Related U.S. Application Data

(60) Provisional application No. 63/389,876, filed on Jul. 16, 2022.

(51) Int. Cl.

| | |
|---|---|
| ***E03C 1/04*** | (2006.01) |
| ***E03C 1/23*** | (2006.01) |
| ***E03C 1/33*** | (2006.01) |

(52) U.S. Cl.

CPC ..... *E03C 1/0401* (2013.01); *E03C 1/2302* (2013.01); *E03C 1/335* (2013.01)

(58) Field of Classification Search

CPC ..... E03C 1/04; E03C 1/0401; E03C 1/0402; E03C 1/2302; E03C 1/335; E03C 2001/0416

USPC ..... 4/591, 592, 631, 675, 695, 696

See application file for complete search history.

(56) References Cited

U.S. PATENT DOCUMENTS

| | | | | |
|---|---|---|---|---|
| 7,007,317 | B1 * | 3/2006 | Brown | E03C 1/33 4/631 |
| 2004/0065367 | A1 * | 4/2004 | Thomas | E03C 1/0402 137/359 |
| 2009/0100595 | A1 * | 4/2009 | Kozacki | E03C 1/0401 4/695 |

* cited by examiner

*Primary Examiner* — Tuan N Nguyen

(74) *Attorney, Agent, or Firm* — Donald L. Wenskay

(57) ABSTRACT

A method for installing deck mounted plumbing fixtures. At least one annular opening is created in a horizontal planar deck. A backing plate is attached to the deck bottom and an installation plug is placed through the opening in the deck so that it rests on the backing plate. The installation plug includes an annular disc and a cylindrical post. A planar member is applied over the deck top surface, the planar member including at least a layer of liquid material. The liquid material is allowed to harden, and the backing plate and the installation plug are removed, thus creating an opening in the planar member. A plumbing fixture is then installed in the opening in the planar member, such that the plumbing fixture is affixed to the top and bottom surface of the planar member and not to the deck.

14 Claims, 7 Drawing Sheets

APPARATUS AND METHOD FOR INSTALLING DECK MOUNTED FAUCETS

FIELD OF INVENTION

The present invention generally relates to the fields of plumbing and building construction. More particularly, the disclosed embodiments relate to a system and method for installing deck mounted faucets.

BACKGROUND

This section is intended to provide a background or context to the disclosed embodiments that are recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Deck mounted faucets are commonly used on bathroom sinks and on decks surrounding master bath soaker tubs. The installation of deck mounted faucets involves passing the body of a faucet through an opening in a faucet deck that is made out of plywood. The faucet body typically has threads, and a nut is screwed onto the threads from the underside of the deck. the nut will then engage with the underside of the deck. Because of the prevalence of water on the deck it sometimes happens that the plywood become wet causing it to swell and contract. This can cause the faucet to become loose. This may necessitate the replacement of the faucet and/or deck.

SUMMARY OF THE INVENTION

Figure 1:
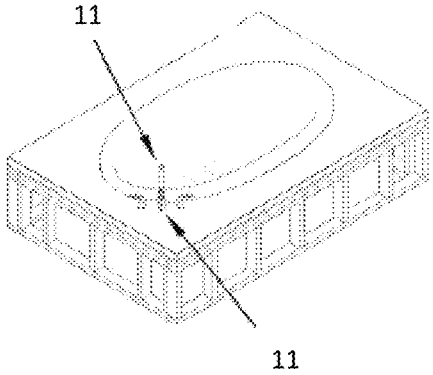
FIG. 1 illustrates an exemplary tub platform with plumbing fixtures installed according to embodiment of the present disclosure.

This section is intended to provide a summary of certain exemplary embodiments and is not intended to limit the scope of the embodiments that are disclosed in this application.

In one embodiment, the disclosed invention describes a method for installing a deck mounted plumbing fixture. At least one annular opening is created in a horizontal planar deck having top and bottom surfaces. A backing plate is attached to the deck bottom surface, the backing plate covering the annular opening in the deck bottom surface, the backing plate having an upper surface facing the annular opening. An installation plug is placed through the opening in the deck so that it rests on the upper surface of the backing plate, the installation plug including an annular disc of approximately the same diameter as the annular opening and a cylindrical post with a diameter smaller than the annular opening protruding upwardly therefrom, the thickness of the annular disc being less than the thickness of the deck, whereby a resulting annular cavity in the deck has a depth that extends from the top surface of the deck to the top surface of the annular disc. The annular disc is attached to the backing plate. A planar member is applied over the deck top surface, the planar member including at least a layer of liquid material, wherein the liquid material covers the top surface of the annular disc, surrounds a lower portion of the cylindrical post, and fills the annular cavity. The liquid material is allowed to harden, and the backing plate and the installation plug are removed, thus creating an opening in the planar member having the diameter of the cylindrical post and extending through the planar member and also creating a recessed annual region below the planar member adjacent to the bottom surface of the deck. A plumbing fixture is then installed in the opening in the planar member, such that the plumbing fixture is affixed to the top and bottom surface of the planar member and not to the deck.

These and other advantages and features of disclosed embodiments, together with the organization and manner of operation thereof, will become apparent from the following detailed description when taken in conjunction with the accompanying drawings.

DETAILED DESCRIPTION OF CERTAIN EMBODIMENTS

In the following description, for purposes of explanation and not limitation, details and descriptions are set forth in order to provide a thorough understanding of the disclosed embodiments. However, it will be apparent to those skilled in the art that the present invention may be practiced in other embodiments that depart from these details and descriptions.

Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosed embodiments relate to an apparatus and method for installing deck mounted plumbing fixtures, such as rough-in valves, including faucets. Examples of a typical installations would be the installation of faucets in the deck of a master bath soaker tub or in bathroom sinks. The disclosed embodiments use an installation plug that is temporarily installed at the framing stage when a plywood top in installed before the final countertop. The liquid waterproofing material is installed around the installation plug. After the waterproofing material hardens, the installation plug is removed. This leaves correctly configured surfaces upon which to mount the plumbing fixture to be mounted to without contact with the plywood surface. This results in a longer lasting installation, by avoiding mounting the plumbing fixture to plywood, which can expand and contract and weaken when exposed to water and causing the plumbing fixture to become loose.

Embodiments of the installation plug include an approximately 4½" base that creates a recessed region below the deck that allows a basin wrench enough room to fit up inside the 4½" recess to tighten down the plumbing fixture, as described in more detail below.

Referring now to FIG. 1, an exemplary tub platform is shown with four plumbing fixtures 11 installed using the installation plug of the disclosed embodiments.

Figure 2:
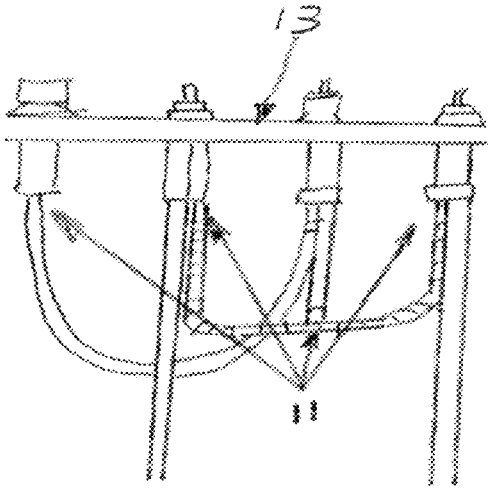
FIG. 2 illustrates a side view of plumbing fixtures including rough-in valves installed in a faucet deck according to one embodiment of the present disclosure.

FIG. 2 illustrates a side view of plumbing fixtures 11 (also referred to as "rough-in valves") installed in a faucet deck 13 according to one embodiment of the present disclosure.

Figure 3:
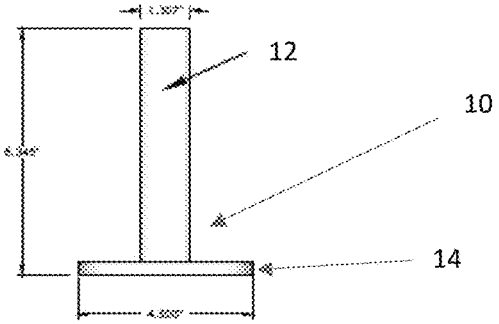
FIG. 3 illustrates a side view of an installation plug according to one embodiment of the present disclosure.

FIG. 3 illustrates a side view of an installation plug 10 according to one embodiment of the present disclosure. The installation plug includes an upper cylindrical portion 12 and a lower annular disc portion 14. In an embodiment, the cylindrical portion 12 is made of hollow PVC tubing and is about 1.307" in diameter and 6.345" long. The annular disc portion 14 may also be made of PVC material and may be about 4.5" in diameter and about 0.435" thick.

Figure 4:
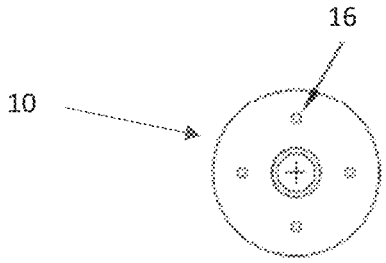
FIG. 4 illustrates a top view of an installation plug according to one embodiment of the present disclosure.
Figure 5:
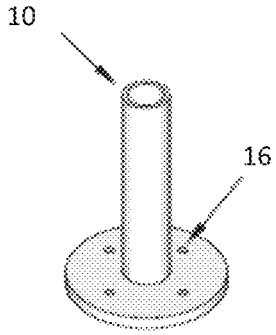
FIG. 5 illustrates a top isometric view of an installation plug according to one embodiment of the present disclosure.
Figure 6:
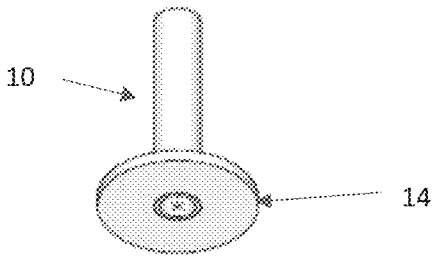
FIG. 6 illustrates a bottom isometric view of an installation plug according to one embodiment of the present disclosure.

FIG. 4 illustrates a top view of an installation plug 10 according to one embodiment of the present disclosure. The cylindrical portion 12 may be attached to the annular disc portion 14 by inserting it into an opening in the annular disc portion 14 and securing it with adhesive. Multiple holes 16 in the annular disc portion are used to secure the installation plug 10 to a deck of the tub platform as described in more detail below. FIG. 5 illustrates a top isometric view of an installation plug 10 according to one embodiment of the present disclosure. FIG. 6 illustrates a bottom isometric view of an installation plug 10 according to one embodiment of the present disclosure.

Figure 7:
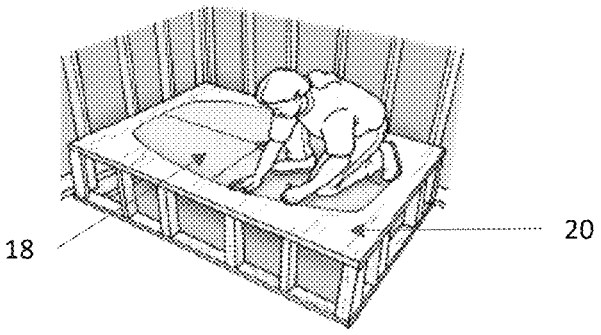
FIG. 7 illustrates the step of marking a tub template on a plywood deck according to one embodiment of the present disclosure.

FIG. 7 illustrates the step of marking a tub template on a plywood deck according to one embodiment of the present disclosure. In particular, the outline of a tub template 18 is drawn on a plywood deck 20 and then the tub area is cut out. The plywood deck may be composed of ¾" thick plywood.

Figure 8:
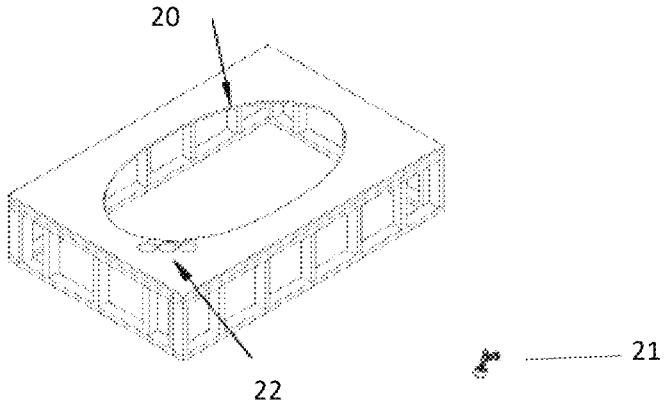
FIG. 8 illustrates a top isometric view of the steps of marking tub valve locations and drilling three holes into the plywood deck according to one embodiment of the present disclosure.
Figure 9:
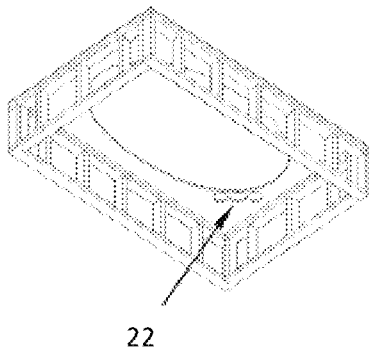
FIG. 9 illustrates bottom isometric view of the underside of the plywood platform with the three holes drilled according to an embodiment of the present disclosure.

FIG. 8 illustrates a top isometric view of the steps of marking tub valve locations and drilling three holes into the plywood 20 deck according to one embodiment of the present disclosure. In more detail, a 4½" hole saw 21 is used to drill three 4½ " holes 22 in the deck 20 in the desired locations for the plumbing fixtures. FIG. 9 illustrates bottom isometric view of the underside of the plywood platform 20 with the three holes 22 drilled through it according to an embodiment of the present disclosure.

Figure 10:
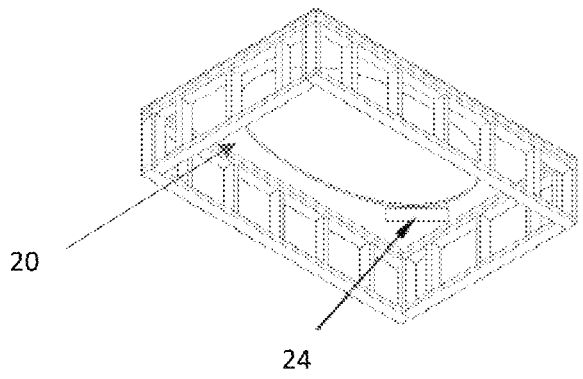
FIG. 10 illustrates a bottom isometric view of the underside of the plywood platform with a plywood backing plate mounted to the underside of the plywood platform over the three holes according to an embodiment of the present disclosure.

FIG. 10 illustrates a bottom isometric view of the underside of the plywood platform 20. A plywood backing plate 24 has been mounted to the underside of the plywood platform over the three holes 22 according to an embodiment of the present disclosure. The plywood backing plate may be made of plywood and may be removably attached with screws onto the bottom of the plywood platform 20 so as to cover the three holes 22.

Figure 11:
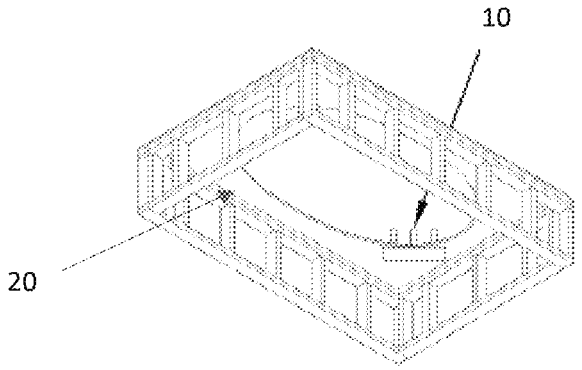
FIG. 11 illustrates a bottom isometric view of the underside of the plywood platform with an installation plug installed into each of the three holes according to an embodiment of the present disclosure.
Figure 12:
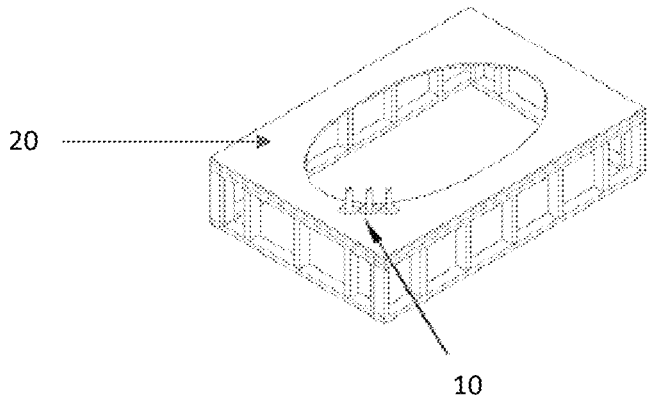
FIG. 12 illustrates a top isometric view of the top of the plywood platform with an installation plug installed into each of the three holes according to an embodiment of the present disclosure.

FIG. 11 illustrates a bottom isometric view of the underside of the plywood platform 20 with an installation plug 10 installed into each of the three holes according to an embodiment of the present disclosure. FIG. 12 illustrates a top isometric view of the top of the plywood platform 20 with an installation plug 10 installed into each of the three holes 22 according to an embodiment of the present disclosure. Since the diameter of the annular disc portion 14 is the same diameter of the holes 22, the installation plug 10 fits snugly into the holes 22 and rests on the top surface of the backing plate 24. Each installation plug 10 is attached to the backing plate 24 using the holes 16 in the installation plug 10.

Figure 13:
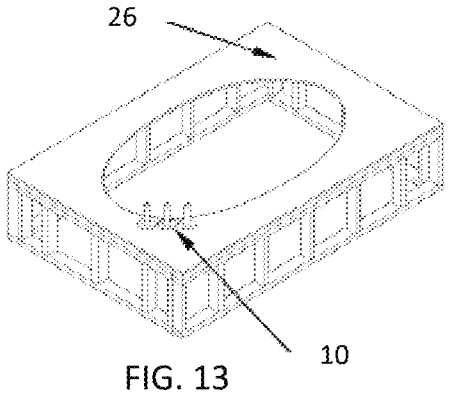
FIG. 13 illustrates a top isometric view of the top of the plywood platform with a waterproofing layer installed over the plywood platform and over an annular portion of the three installation plugs according to an embodiment of the present disclosure.

FIG. 13 illustrates a top isometric view of the top of the plywood platform 20 with a waterproofing layer 26 installed over the plywood platform 20 and over the annular disc portion 14 of the three installation plugs 10 according to an embodiment of the present disclosure.

Figure 14:
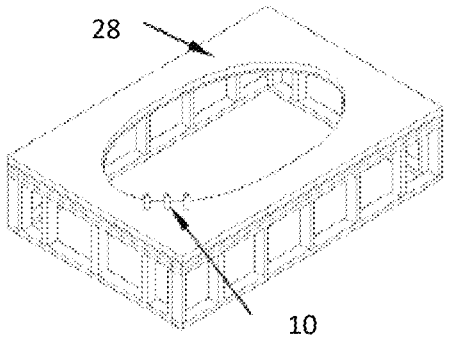
FIG. 14 illustrates a top isometric view of the top of the plywood platform with a mortar float layer installed over the waterproofing layer according to an embodiment of the present disclosure.

FIG. 14 illustrates a top isometric view of the top of the plywood platform 20 with a mortar float layer 28 installed over the waterproofing layer 26 according to an embodiment of the present disclosure.

Figure 15:
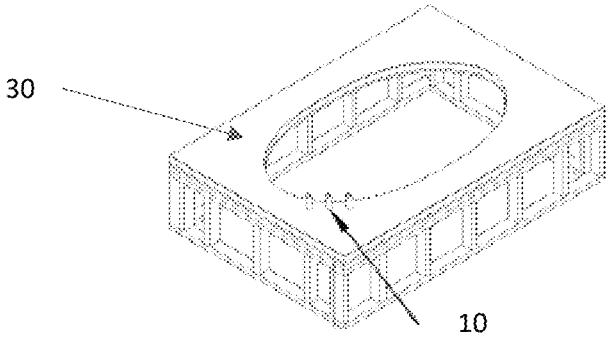
FIG. 15 illustrates a top isometric view of the top of the plywood platform with a tile layer installed over the mortar float layer according to an embodiment of the present disclosure.

FIG. 15 illustrates a top isometric view of the top of the plywood platform 20 with a tile layer 30 installed over the mortar float layer 28 according to an embodiment of the present disclosure. A shown in FIG. 15, the tile layer 30 has openings cut into it so that the three installation plugs 10 protrude above the tile layer 30.

Figure 16:
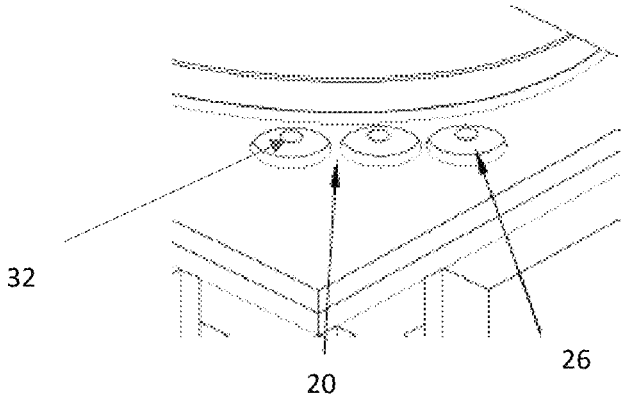
FIG. 16 illustrates a bottom isometric view of the bottom of the plywood platform with the plywood backing plate removed and also the three installation plugs removed according to an embodiment of the present disclosure.
Figure 17:
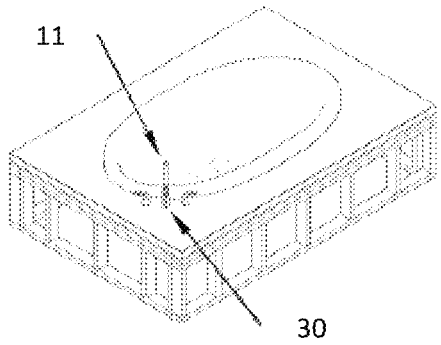
FIG. 17 illustrates a top isometric view of the plywood platform with the valves and faucet installed according to an embodiment of the present disclosure.

FIG. 16 illustrates a bottom isometric view of the bottom of the plywood platform 20 with the plywood backing plate 24 removed and also the three installation plugs 10 removed according to an embodiment of the present disclosure. The plywood backing plate 24 and the three installation plugs 10 may be removed as single unit by striking the top of the three installation plugs 10 with a hammer. FIG. 16 also shows that with the installation plugs 10 removed there is an opening 32 in the waterproofing, mortar float and tile layers (26, 28, 30) configured to receive the plumbing fixture 11. Also, a recessed region 34 has been created to facilitate the installation of the plumbing fixture 11, as described in more detail below. Also, the bottom surface of the waterproofing layer 26 is exposed. As described in more detail below, plumbing fixture 11 will be attached to the bottom surface of the waterproofing layer 26 and at the top to the tile layer 30. As a result of the above steps, the plumbing fixture 11 will not be attached to the plywood platform 20, as in conventional construction techniques. FIG. 17 illustrates a top isometric view of the plywood platform 20 with plumbing fixtures 11 (e.g., valves and faucet) installed according to an embodiment of the present disclosure.

Figure 18A:
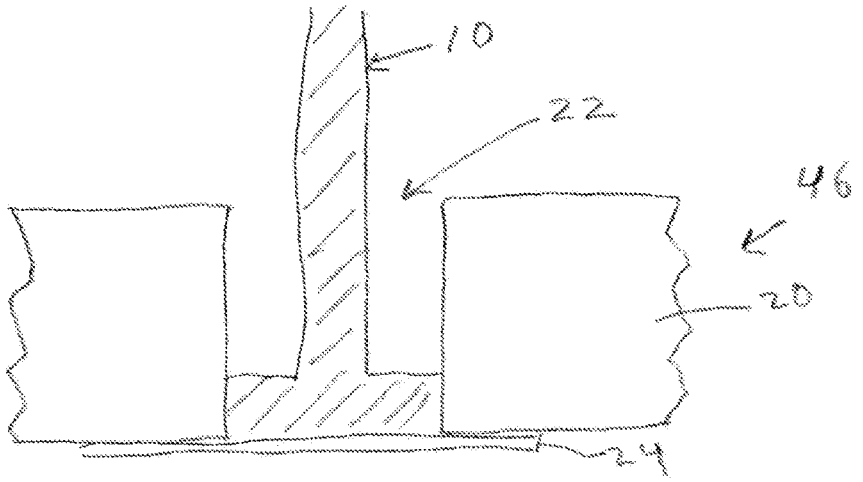
FIGS. 18A-C illustrate side sectional views of three stages of the installation of a plumbing fixture using the installation plug according to an embodiment of the present disclosure.
Figure 18B:
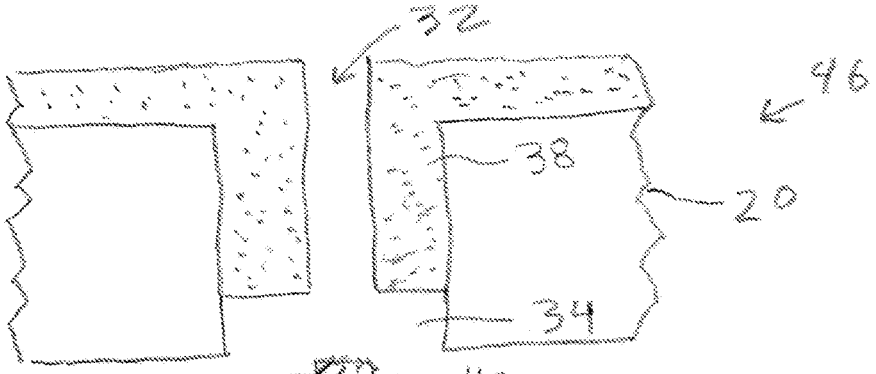
Figure 18C:
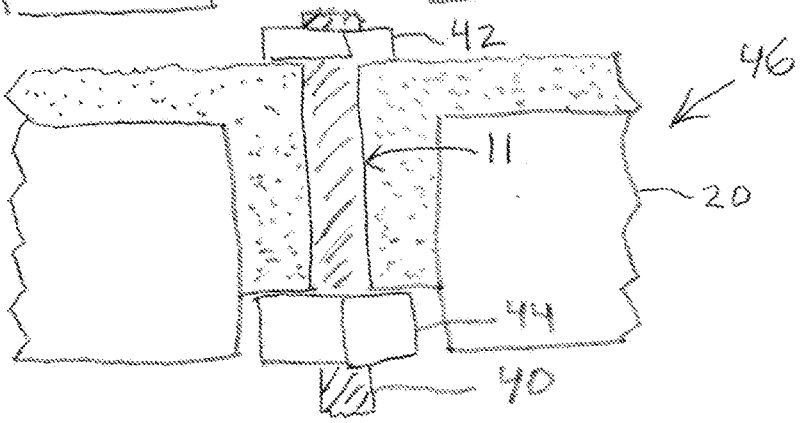

FIGS. 18A-C illustrate sectional side views of three stages of the creation of a portion of a plumbing deck assembly 46. In particular, the three stages describe the installation of a plumbing fixture 36 using the installation plug 10 according to an embodiment of the present disclosure. In more detail and with reference to FIG. 18A, a plywood deck 20 has a circular opening 22 with a backing plate 24 attached at a lower surface. An installation plug 10 is inserted into the opening 22 and attached to the backing plate 24. A multilayer planar member 38 is created over the plywood deck and the installation plug 10. This multilayer planar member 38 may comprise the waterproofing, mortar float and tile layers (26, 28, and 30) described above. Once the multilayer planar member 38 hardens, the installation plug 10 and backing plate are removed as a single unit by applying downward pressure on the installation plug 10. The result is shown in FIG. 12B. A cylindrical opening 32 and a recessed region 34 are created in the multilayer planar member 38 by the removal of the installation plug 10.

FIG. 18C illustrates the final step according to an embodiment of the invention. A plumbing fixture 11 is installed in the opening 32 and in the recessed region 34. The plumbing fixture 11 includes a threaded shaft 40 with a diameter less than the diameter of the opening 32. A top nut 42 and a bottom nut 44 secure the threaded shaft 40 to the deck assembly 46. Notably, the threaded shaft 40 is attached to the multilayer planar member 38 unit without direct contact with the plywood deck 20. As a result, the plumbing fixture 11 stays secure and will not come loose even if the plywood deck expands, contracts or weakens due to exposure to moisture or rotting. Another advantage of the disclosed embodiment is that the recessed area 34 is configured to provide sufficient space around nut 44 to enable the use of conventional tools to tighten it.

From the above description, it can be seen that the present invention provides a system and method for implementing the embodiments of the invention. References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for installing a deck mounted plumbing fixture comprising:

creating at least one annular opening in a horizontal planar deck having top and bottom surfaces;

attaching a backing plate to the deck bottom surface, the backing plate covering the annular opening in the deck bottom surface, the backing plate having an upper surface facing the annular opening;

placing an installation plug through the opening in the deck so that it rests on the upper surface of the backing plate, the installation plug including an annular disc of approximately the same diameter as the annular opening and a cylindrical post with a diameter smaller than the annular opening protruding upwardly therefrom, the thickness of the annular disc being less than the thickness of the deck, whereby a resulting annular cavity in the deck has a depth that extends from the top surface of the deck to the top surface of the annular disc;

attaching the annular disc to the backing plate;

applying a planar member over the deck top surface, the planar member including at least a layer of liquid material, wherein the liquid material covers the top surface of the annular disc, surrounds a lower portion of the cylindrical post, and fills the annular cavity;

allowing the liquid material to harden;

removing the backing plate and the installation plug, thus creating an opening in the planar member having the diameter of the cylindrical post and extending through the planar member and also creating a recessed annual region below the planar member adjacent to the bottom surface of the deck; and installing a plumbing fixture in the opening in the planar member, such that the plumbing fixture is affixed to the top and bottom surface of the planar member and not to the deck.

2. The method of claim 1 wherein the backing plate is made of plywood.

3. The method of claim 1 wherein the installation plug is removably attached to the backing plate by means of screws.

4. The method of claim 1 wherein the step of applying one or more layers comprises applying a layer of water proofing material and a layer of mortar and allowing the waterproofing material and mortar to set.

5. The method of claim 1 wherein the one or more layers of material covering the deck upper surface includes a finish material as a top layer and wherein the bottom of the faucet fixture rests on the finish material.

6. The method of claim 5 wherein the finish material is a rigid material selected from the following: ceramic tile, stone, and synthetic stone.

7. The method of claim 1 wherein the diameter of the cylindrical post is approximately the same as the diameter of a plumbing fixture to be installed in the deck.

8. The method of claim 1 wherein installing a plumbing fixture further comprises:

inserting a threaded cylindrical member through the top opening in the finished material;

screwing a nut onto the threaded cylindrical member from below the deck such that the nut engages with the underside of the planar member and not with the deck material.

9. The method of claim 8 wherein the nun is disposed in the recessed annular region.

10. The method of claim 1 wherein the installation plug is composed of PVC material.

11. The method of claim 1 wherein the installation plug annular disc has a diameter of approximately 4.5 inches.

12. The method of claim 1 wherein the installation plug cylindrical post has a diameter of about 1.3 inches.

13. The method of claim 1 wherein the plumbing fixture is faucet valve body.

14. An installation plug assembly for use in installing deck-mounted plumbing fixtures, comprising:

an installation plug having an annular disc of approximately the same diameter as an annular opening in a planar deck, and a cylindrical post with a diameter smaller than the annular opening and protruding upwardly therefrom, the thickness of the annular disc being less than the thickness of the deck, whereby a resulting annular cavity in the deck has a depth that extends from the top surface of the deck to the top surface of the annular disc;

a backing plate attached to the annular disc and also to the bottom surface of the deck; wherein a planar member including at least a layer of liquid material is applied over the deck top surface, wherein the liquid material covers the top surface of the annular disc, surrounds a lower portion of the cylindrical post, and fills the annular cavity and wherein after the liquid material hardens, the backing plate and the installation plug are removed thus creating an opening in the planar member having the diameter of the cylindrical post and extending through the planar member and also creating a recessed annual region below the planar member adjacent to the bottom surface of the deck; whereby a plumbing fixture can be installed in the opening in the planar member, such that the plumbing fixture is affixed to the top and bottom surface of the planar member and not to the deck.

* * * * *